US005480249A

United States Patent [19]

Kageyama et al.

[11] Patent Number: 5,480,249

[45] Date of Patent: Jan. 2, 1996

[54] LEAD DISPENSING STORAGE CONTAINER

[75] Inventors: Shuhei Kageyama; Shohji Anzai; Tomiji Ueki; Yoshihide Mitsuya, all of Kawagoe, Japan

[73] Assignee: Kotobuki & Co., Ltd., Kyoto, Japan

[21] Appl. No.: 177,205

[22] Filed: Jan. 4, 1994

Related U.S. Application Data

[63] Continuation of Ser. No. 952,957, Sep. 29, 1992, abandoned.

[30] Foreign Application Priority Data

Oct. 21, 1991 [JP] Japan ..... 3-085533 U
Jan. 14, 1992 [JP] Japan ..... 4-004817 U

[51] Int. Cl.[6] ..... B65D 85/20; A45C 11/34

[52] U.S. Cl. ..... 401/60; 401/59; 401/82; 401/85; 401/89; 401/280; 220/253; 220/346; 206/443; 206/214; 206/229

[58] Field of Search ..... 401/59, 60, 82, 401/85, 89, 88, 280; 220/253, 346, 348; 206/443, 214, 224, 229, 540, 528, 538

[56] References Cited

U.S. PATENT DOCUMENTS 1,163,782 12/1915 Seckman ..... 220/346 X
2,534,100 12/1950 Baumgartner ..... 206/229 X
4,403,691 9/1983 Kageyama et al. ..... 401/89 X
4,492,316 1/1985 Emms ..... 206/540 X
4,811,842 3/1989 Sekiya ..... 206/443
4,984,288 1/1991 Petterson ..... 206/443 X

FOREIGN PATENT DOCUMENTS 1315861 12/1962 France ..... 206/540
425086 5/1967 Switzerland ..... 206/540

*Primary Examiner*—Danton D. DeMille
*Attorney, Agent, or Firm*—David O'Reilly

[57] ABSTRACT

A lead dispensing storage container that can be opened or closed by a single hand. The container body has a lead case formed therein, and a lead outlet allowing release of leads one by one. A gate member mounted in the container body can be moved to open or close lead paths between the lead case and lead outlet. An elastic arm portion forces the gate member to move in direction to close the lead paths. The number of parts is reduced, and supplying leads can be made easier by a case that has a lead supply opening projecting from the tip thereof. A leading end of the case has an inclined slope toward the lead supply opening therein, and a chuck containing leads having a knocking portion that is pressed into the case so that it can be opened by the knocking portion being pushed to press an opening actuator toward the inclined slope or is closed by an elastic force as the opening actuator is released.

2 Claims, 5 Drawing Sheets

LEAD DISPENSING STORAGE CONTAINER

This is a continuation of application Ser. No. 07/952,957 filed on Sep. 29, 1992, now abandoned.

FIELD OF THE INVENTION

The present invention relates to a lead dispensing storage container that contains leads for use in mechanical pencils and drawing devices.

1. Background of the Invention

There are many applications for lead dispensing storage containers which can contain leads for use in mechanical pencils and drawing devices. For example, a known lead storage container is simple cartridge as shown in FIG. 4. Container 1 comprises, for example, a quadratic box-like container body 2, and cap 3 that can be caped over or detached from container body 2. This type of lead storage container, however, has the disadvantage that if a user takes cap 3 off to get a desired number of leads, all the leads may fall out of container body 2 and scatter.

In order to solve this problem, an improvement was proposed in the Japanese Utility Model Application Laid-Open 61-34156. This improved lead dispensing storage container has a quadratic box-like container body, a cap turnably fitted with the quadratic container body and a narrow lead outlet therein. The user can take a desired number of leads out through the lead outlet only by turning the cap to a corresponding degree from the container body. The improved lead dispensing storage container mentioned above is desirable in that it needs fewer component parts, is simple in structure, and overcomes the problem that all the leads may fall out of the container body. However, it heretofore also has the disadvantage in use that the cap has to be returned to the home position after it has been turned to an angle for taking out leads. It therefore is desirable to reduce laborious handling of the cap to open or close the lead outlet.

The disadvantages of the prior art discussed above are overcome by the present invention.

Another conventional lead storage container shown in FIG. 8 has a casing formed with sealing plate 59 fitted to U-shaped body 58 having a bottom. The casing stores leads, and has lid 60 slidably mounted on a side with lead supply opening 42 to open or close it.

In order to supply the leads into a lead tank of a mechanical pencil or the like from the conventional lead storage container, lid 60 is slid to open lead supply opening 42, and leads are taken out and put into the lead tank.

However, the conventional lead storage container has the disadvantage of being complicated in structure and expensive as it is made up of three components, including U-shaped body 58, sealing plate 59, and slidably mounted lid 60. It also is disadvantageous in that supplying leads is hard.

2. Brief Description of the Invention

In view of the foregoing, it is a general object of the present invention to provide a lead dispensing storage container that can open or close a lead outlet each time with a single hand.

Briefly stated, the lead dispensing storage container of the present invention container comprises in combination: container body 11 having a lead case 15 formed therein and lead outlet 16 allowing release of leads one by one. Gate member 19 is mounted in container body 11 and can be moved to open or close lead path between lead case 15 and lead outlet 16 and elastic arm portion 21 or 21*a* to force gate member 19 to move in a direction to close the lead paths.

Also, the lead dispensing storage container described above can be made, wherein container body 11 has upper case 31 and lower case 32 which covers upper case 31. At least one of upper case 31 and lower case 32 has a lead path for communicating with lead case 15 and lead outlet 16 and has a mounting portion for gate member 19 and elastic arm portion (forcing member) 21*a* to supply a force to gate member 19. Upper case 31 and lower case 32 have a securing portions 33 and portion 34 respectively which can separably secure them together if the lower case 32 is covered by upper case 31.

Alternatively, the lead dispensing storage container of the present invention comprises in combination: container body 11 having inner case 13 with lead case 15 and outer case 12 having lead outlet 16 communicating with lead case 15 that is demountably inserted in inner case 13. Gate member 19 can be moved to open or close lead paths between inner case 13 and outer case 12 and is characterized by gate member 19 being finger pressing portion 20 and elastic arm portion 21 integrated with inner case 13. Finger pressing portion 20 faces out from an opening of outer case 12 and elastic arm portion 21 always forces gate member 19 to move toward closing the lead path of inner case 13 and lead path of outer case 12.

BRIEF DESCRIPTION OF THE DRAWINGS

The features and advantages of the present invention will be more fully understood by reference to the following drawings.

In the drawings.

DETAILED DESCRIPTION OF THE INVENTION

Figure 1:
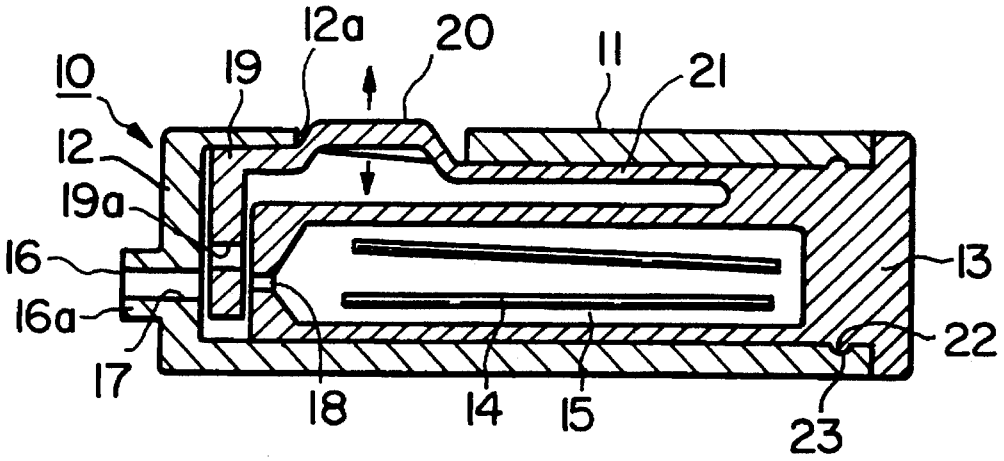
FIG. 1 is a cross-sectional view of a first embodiment of a lead dispensing storage container of the present invention.
Figure 2:
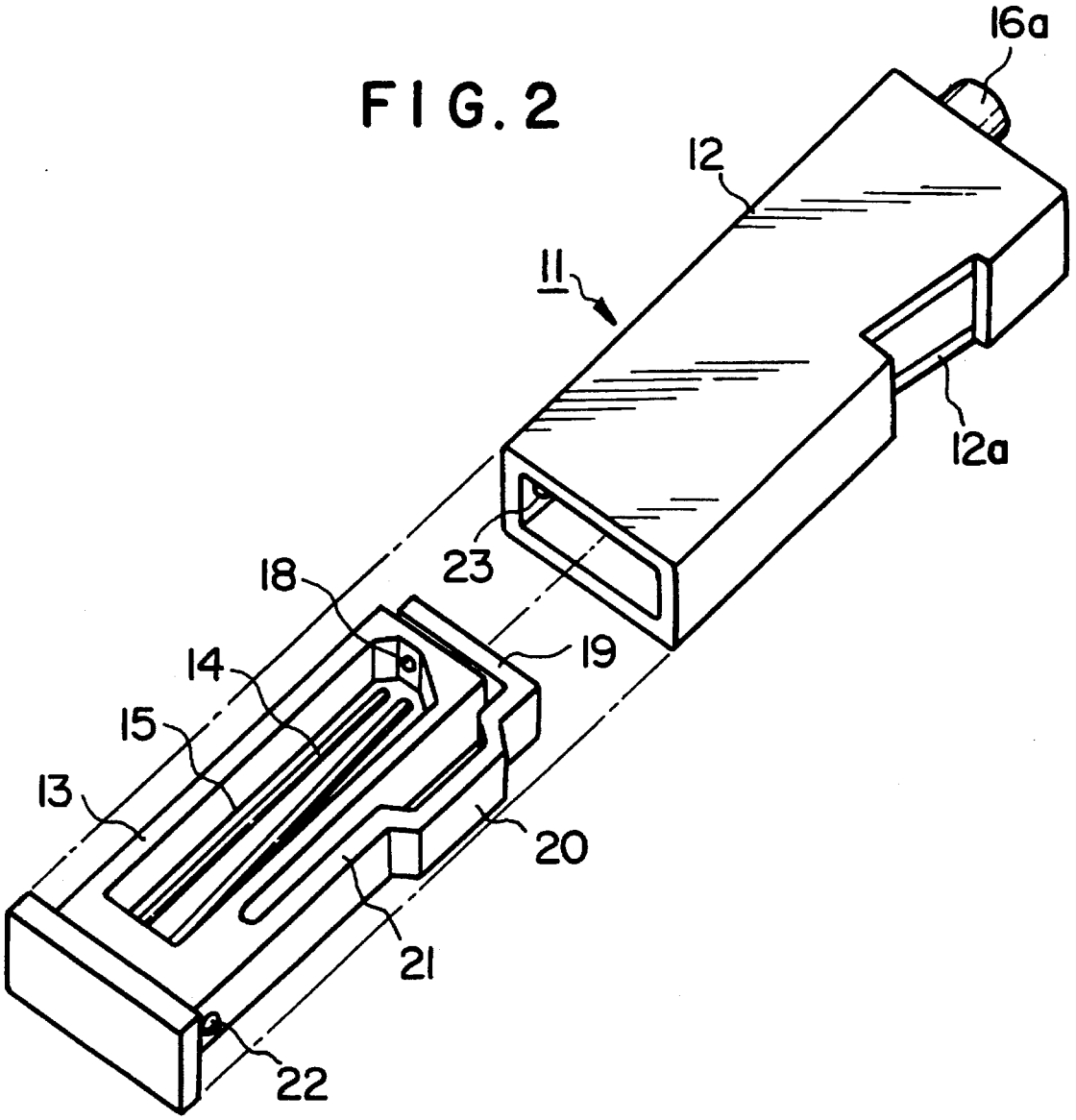
FIG. 2 is an exploded perspective view of the first embodiment of lead dispensing storage container shown in FIG. 1.

Referring now to the figures, embodiments of the lead dispensing storage container of the present invention for mechanical pencil are described below. FIGS. 1 and 2 show lead container 10 of a first embodiment. Lead case 10 has container body 11 comprised of rectangular hollow outer case 12 and box-like inner case 13 detachably fitted in outer case 12.

The inner case 13 has lead case 15 for leads 14 therein. Outer case 12 has lead outlet 16 for releasing leads 14 one by one, Lead outlet 16 is provided in trapezoidal projection 16*a* of outer case 12.

Inner case 13 and outer case 12 have lead paths 17 and 18 linearly aligned to lead outlet 16 in a fitting direction of outer case 12 and inner case 13.

Inner case 13 also has gate member 19 provided between lead path 18 of inner case 13 and fitting hole 17 of outer case 12 for opening or closing lead paths 17 and 18.

Gate member 19 has integral finger pressing actuator portion 20 engaging opening 12*a* of outer case 12. Finger pressing actuator portion 20 has elastic arm portion 21 (forcing member) integrated together to force gate member 19 to move to a position that closes lead path 18 of inner case 13 and lead path 17 of outer case 12. Elastic arm portion 21 is integrated with inner case 13.

Gate member 19 has lead hole 19*a* corresponding to lead paths 17 and 18 as it is reciprocally moved perpendicularly to lead paths 17 and 18. If lead hole 19*a* is aligned with lead paths 17 and 18, leads 14 can be released. If lead hole 19*a* is out of a aligned position with lead paths 17 and 18, gate member 19 closes lead outlet 16 preventing leads 14 from being released.

Inner case 13 having leads 14 is fitted in outer case 12. In order to prevent inner case 13 from being easily removed, the inner case 13 and outer case 12 have a fitting projection 22 and a corresponding fitting concave detent 23, respectively.

As seen in FIG. 1, the embodiment described above has the advantage that in order to release leads 14 from the lead case 10, only finger pressing portion 20 need be pressed into outer case 12 as shown by arrow. As a result, gate member 19 puts lead paths 17 and 18 in communication to open lead outlet 16. In this state, a desired number of leads 14 can be dispensed before finger pressing portion 20 is released. This allows gate member 19 to cut off lead paths 17 and 18 to automatically return to positions that close lead outlet 16 by the force of elastic arm portion 21 as shown by the arrow. This allows the use of a single hand to open or close lead outlet 16 each time.

Figure 3:
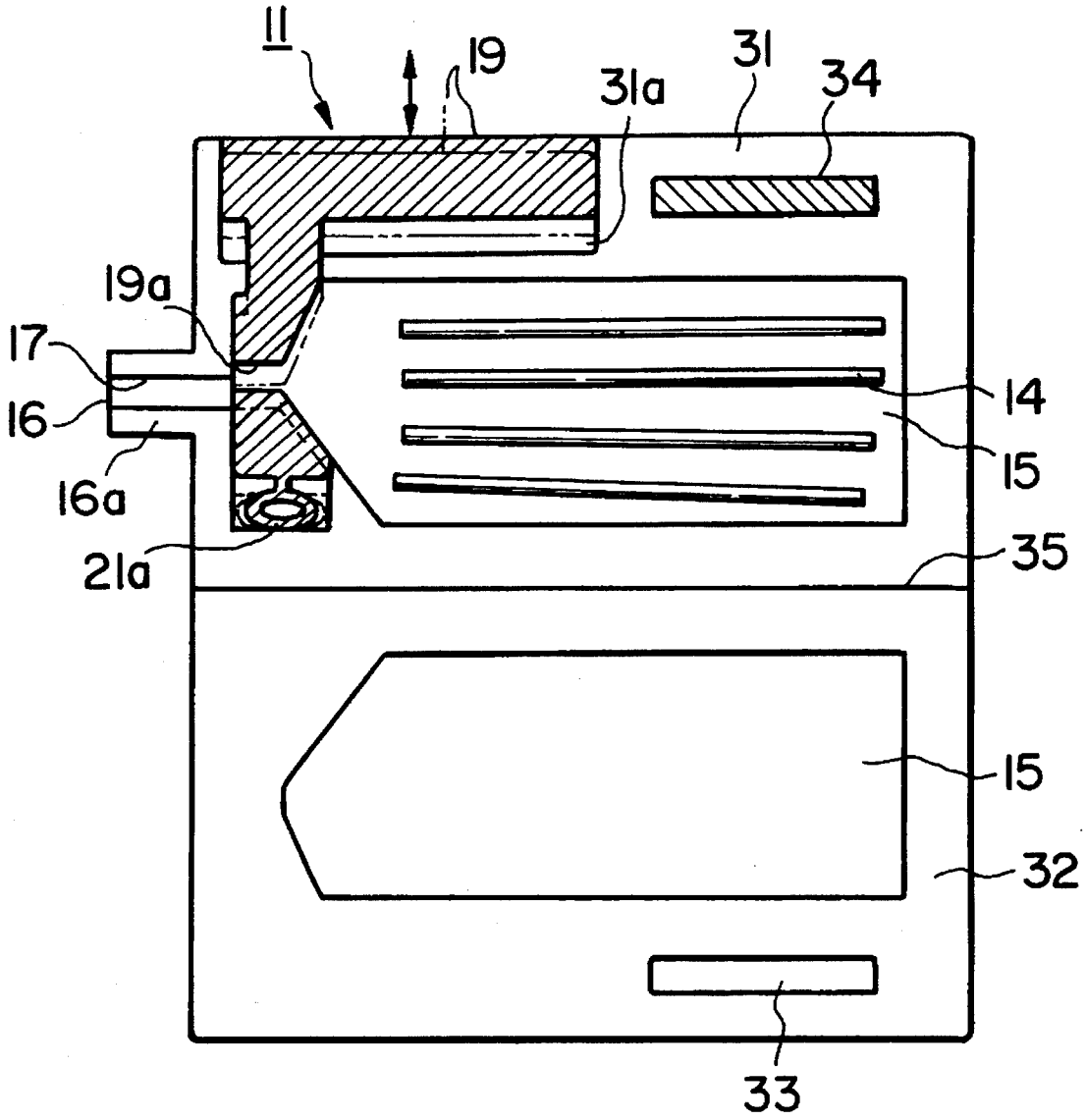
FIG. 3 is a partly cross-sectioned plan view of a second embodiment of the lead dispensing storage container of the present invention.
Figure 4:
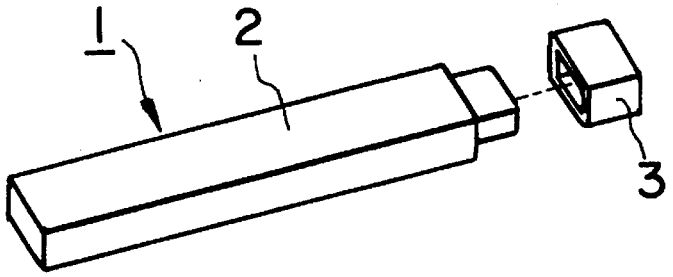
FIG. 4 (PRIOR ART)
FIG. 4 is an exploded perspective view of a conventional lead dispensing storage container.

FIG. 3 is a second embodiment of the present invention, container body 11 of this embodiment comprises upper case 31 and lower case 32 that covers it. At least one of upper case 31 and lower case 32 has lead storage case 15 for leads 14. Lead outlet 16, has hole 17 for making lead storage case 15 and lead outlet 16 communicate, and mounting concave 31*a* for gate member 19 and forcing member 21*a* (forcing member) for forcing it open.

In the second embodiment, gate member 19 is formed separately from container body 11, including upper case 31 and lower case 32. Forcing member 21*a* is integrated with gate member 19 as formed, for example, of hollow elastic ball. Or, it may be separately formed of the usual spring.

Upper case 31 and lower case 32 have respective engaging portions 33 and 34 to separably secure together when upper case 31 covers lower case 32. Upper case 31 and the lower case 32 can also be coupled with a thin-wall self-hinge 35 or may be separated.

In the second embodiment, leads 14 are contained in lead storage case 15 before lower case 32 fits over and covers upper case 31. Leads 14 can be released by handling gate member 19 as in the first embodiment.

In operation, to remove leads from the lead container, a user should hold the lead container by one hand, and should move the gate member to a lead path opening position by the thumb finger or the like. After releasing leads, the user should release the gate member. The gate member then will automatically return to a lead path closing position.

The advantages of the first and second embodiments of the present invention consist in particular in the fact that the leads can be released from the lead container one at a time by a single hand.

Figure 5:
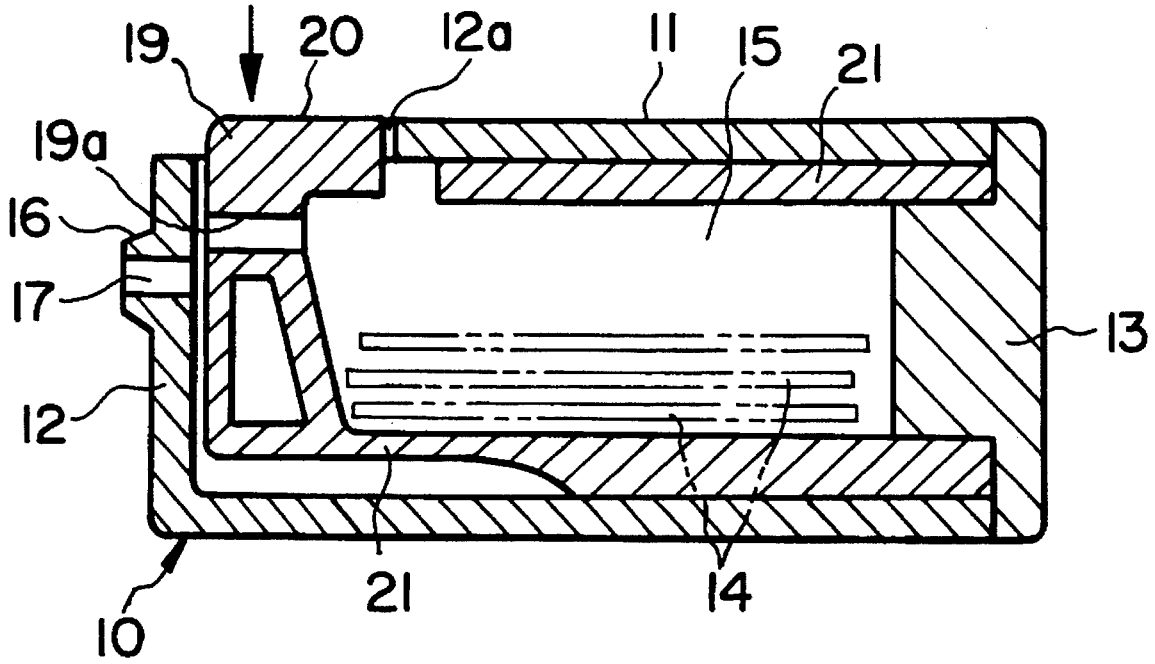
FIG. 5 is a cross sectional view of a third embodiment of the invention.
Figure 8:
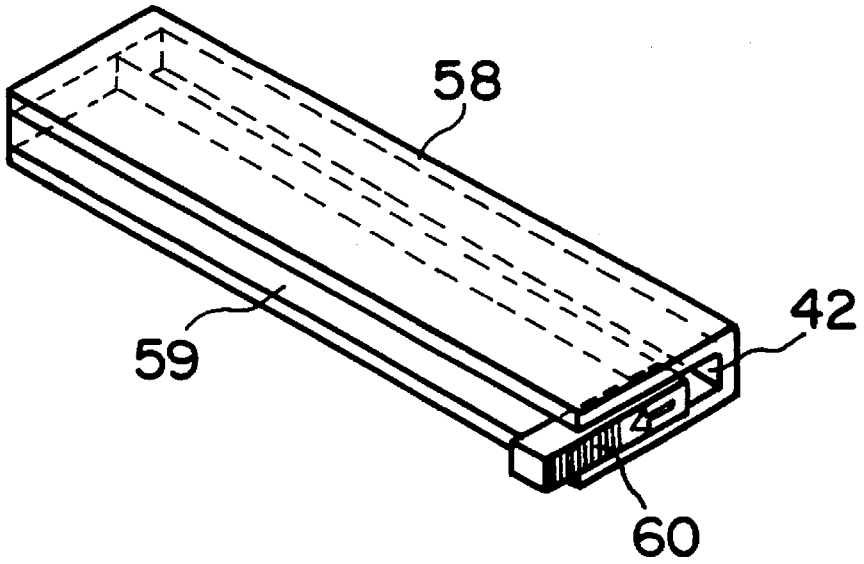
FIG. 8 (PRIOR ART)
FIG. 8 is a perspective view of a conventional lead dispensing storage container.

FIG. 5 shows a cross section of a third embodiment of this invention using same numerals for the same parts as the first embodiment. In this embodiment, lead release path 18 is eliminated and elastic arm portion 21 is formed as part of the inner wall of lead case 15.

Figure 6A:
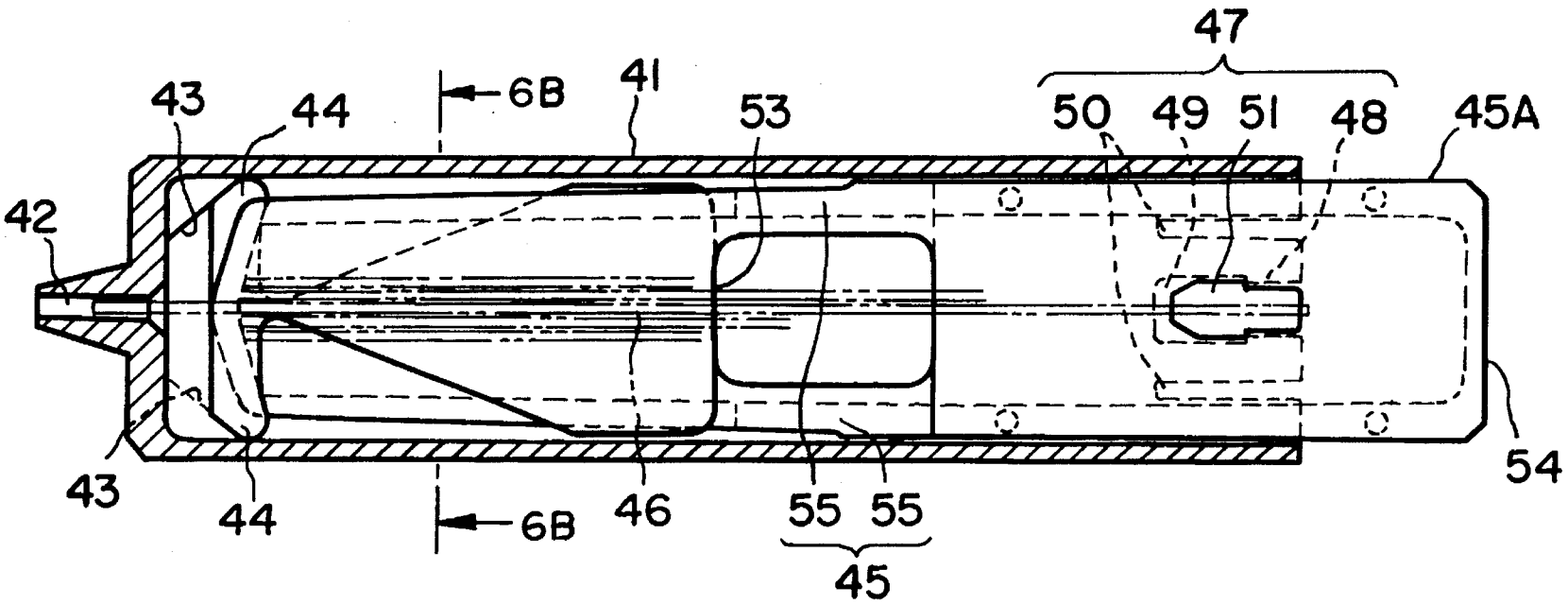
FIG. 6A is a partly cross-sectioned plan view of a fourth embodiment of the lead dispensing storage container of the present invention.
Figure 6B:
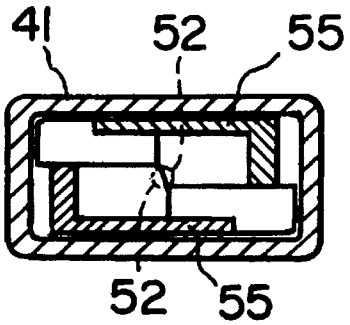
FIG. 6B is a cross-sectional view of the fourth embodiment taken at 6B—6B of FIG. 6A.
Figure 7:
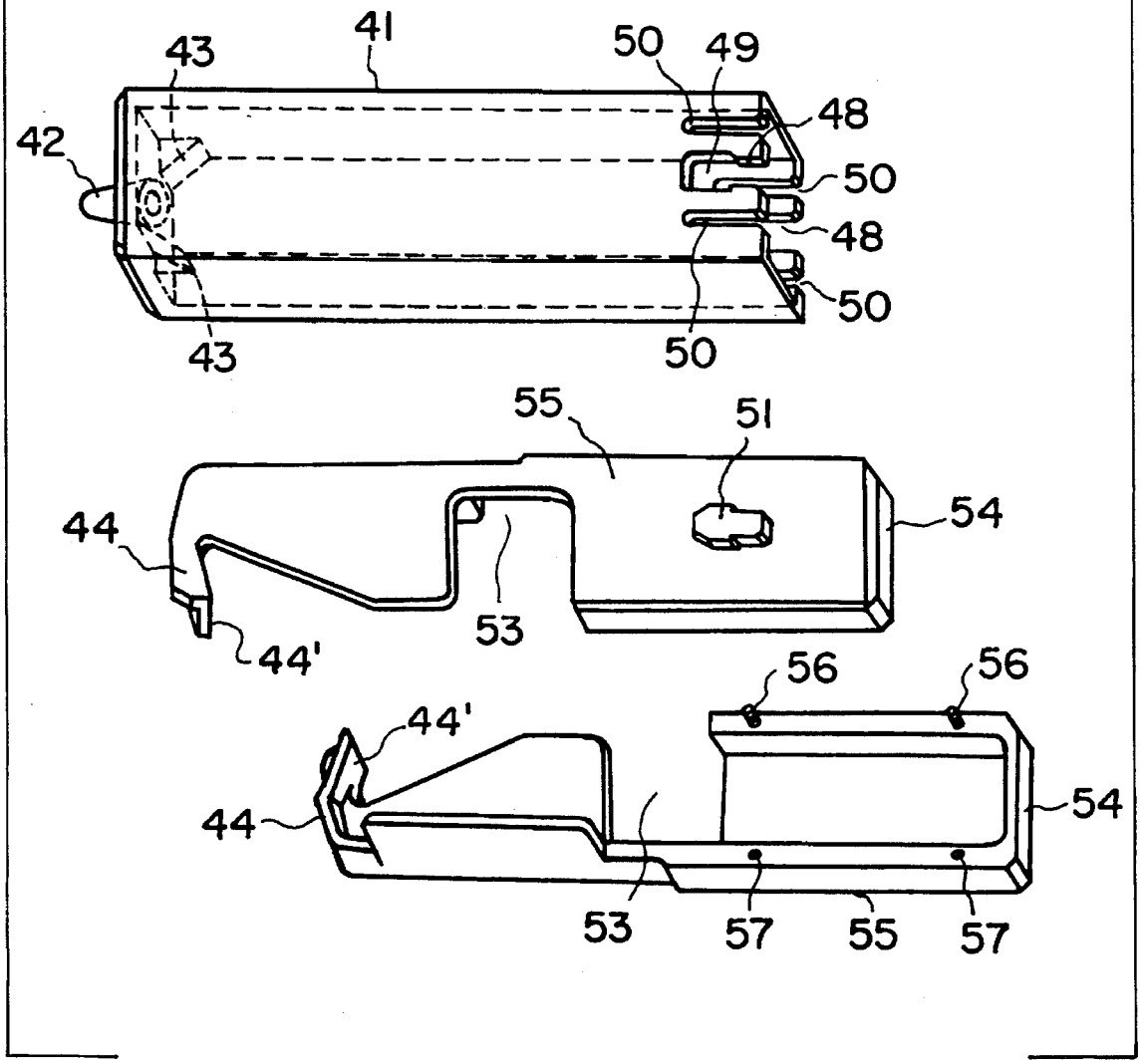
FIG. 7 is an exploded perspective view of the major parts of the third embodiment.

A fourth embodiment is shown in FIGS. 6 and 7. Case 41 has a lead supply opening 42 projecting from its tip. The tip of case 41 has down slope 43 leading toward lead supply opening 42 therein.

Case 41 has chuck 45 having knocking portion 45A pressed therein that can be opened as knocking portion 45A is pushed to press opening actuator 44 to down slope 43 or can be closed by the elastic force itself as it is released. Chuck 45 is formed of opening actuators 44 that form an opening or gap 52 at a leading end when operated and two coupled chuck members 55 having a flexing cut-out portion 53 at its intermediate portion and a cap 54 at its trailing end.

Chuck 45 has leads 46 contained therein. Case 41 has fitting means 47 provided therein to prevent chuck 45 from separating outward, Fitting means 47 comprises neck hole 48 at an open end of case 41, communicating with fitting hole 49, cut-outs 50 parallel to neck hole 48 and fitting hole 49, and fitting portion 51 at a rear of the chuck 45 for fitting with the fitting hole 49 through neck hole 48.

In the fourth embodiment described above, chuck 45 is formed with the two chuck members 55 filled with leads and with projections or studs 56 and fitting holes or sockets 57 secured together. Chuck 45 is inserted into case 41 from a rear end thereof. Fitting portion 51 of chuck 45 presses neck hole 48 to deform and expand wider before being secured in fitting hole 49.

In operation, in order to supply the leads into the lead tank of a mechanical pencil or the like from the lead dispensing storage container of the present invention, lead supply opening 42 should be pointed downward, and knocking portion 45A pressed. Opening actuator 44 of chuck 45 is pressed against down slope 43 of case 41 to open chuck 45 to drop lead 46 from lead supply opening 42 into the lead tank. After supplying lead 46, knocking portion 45A should be released. Opening actuator 44 of chuck 45 then is reset by its own elastic force to close. If the lead 46 in the outlet is pinched by chuck 45, then lead supply opening 42 should be directed upward, and knocking portion 45A pressed to open chuck 45. The lead 46 in the outlet in chuck 45 will the drop down to return.

If the tip outside diameter of the lead supply opening 42 in the third embodiment can be sized so that tip can be inserted in to the lead tank of a mechanical pencil or the like, this assures the further supply of lead will not occur to cause failure of the lead supply into the lead tank. It should be noted that the flexing cut-out portion 53 provided at the intermediate portion makes further easy opening or closing of gap 52 of chuck 45.

The lead container of the third embodiment is not only simpler and cheaper than the conventional one, but also can supply leads easier. This is because as described above, case 41 has lead supply opening 42 projecting therefrom at a tip thereof, and the leading end of case 41 has down slope 43 leading toward lead supply opening 42 therein. Chuck 45 has knocking portion 45A to be pressed to case 41 so that it can be opened as knocking portion 45A is pushed to press opening actuator 44 against down slope 43 or is closed by the elastic force itself as it is released, and chuck 45 contains leads 46.

What is claimed is:

1. A lead dispensing storage container comprising;

an outer case (12) open at one end having an outlet (16) in the opposite end and an opening (12*a*) in a side wall thereof;

an inner case (13) slidably fitting into the open end of said outer case (12), said inner case having;

four walls encompassing a storage compartment (15) for storing leads, one of said four walls having a lead path outlet (18) in alignment with said outlet in said outer case and having a tapered surface (43) adjacent to said lead path outlet (18), and, resilient actuating gate means comprised of a resilient (21) extending along and contacting a side wall of said outer case, a pressing portion (20) projecting outward from the said opening (12*a*) in the side wall of said outer case (12), and a gate portion (19) positioned between the opposite end of the outer case and one of the four walls encompassing the storage compartment, said gate portion having a gate opening (19*a*), said resilient arm (21) being constructed to press against side wall of said outer case (12) to prevent said inner case (13) from accidentally slipping out of the open end of said outer case, said pressing portion (20) being biased outward into said opening (12*a*) in a side wall of said outer case (12) so that said gate opening (19*a*) in the gate portion is normally out of alignment with the lead path outlet (18) in said inner case and the outlet (16) in said outer case (12), whereby pressing said pressing portion (20) inward moves said gate opening in the gate portion to align with the lead path outlet in said inner case and the outlet in said outer case, dispensing lead from said storage case.

2. The container according to claim 1 including securing means detachably securing said inner case (13) in said outer case (12), said securing means comprising one or more detents (23) on one or more inside surfaces of said outer case (12) and one or more mating projections (22) on one or more outside surfaces of said inner case that snap into said detents.

* * * * *

UNITED STATES PATENT AND TRADEMARK OFFICE

CERTIFICATE OF CORRECTION

PATENT NO. : 5,480,249

DATED : January 2, 1996

INVENTOR(S) : Shuhei Kageyama et al

It is certified that error appears in the above-identified patent and that said Letters Patent is hereby corrected as shown below:

Claim 1, Column 5, line 25 after "resilient" insert -- arm --.

Signed and Sealed this

Fourteenth Day of January, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,480,249

DATED : January 2, 1996

INVENTOR(S) : Shuhei Kageyama et al.

It is certified that error appears in the above–identified patent and that said Letters Patent is hereby corrected as shown below:

Claim 1, Column 5, line 22, delete "(43)".

Signed and Sealed this

Eighth Day of July, 1997

Bruce Lehman

*Attest:*

BRUCE LEHMAN

*Attesting Officer*

*Commissioner of Patents and Trademarks*